US009322220B2

(12) United States Patent
Innes et al.

(10) Patent No.: US 9,322,220 B2
(45) Date of Patent: Apr. 26, 2016

(54) REMOTELY OPERABLE UNDERWATER DRILLING SYSTEM AND DRILLING METHOD

(75) Inventors: Ronald W. Innes, Edmonton (CA); Daniel P. Teeuwsen, Edmonton (CA); Dustyn J. L. Elford, Sherwood Park (CA); John T. Hackett, Beaumont (CA); Mark Gurnett, Sherwood Park (CA); Tan N. Nguyen, Edmonton (CA); Donald B. Grass, Edmonton (CA)

(73) Assignee: Marl Technologies, Edmonton (CA)

( * ) Notice: Subject to any disclaimer, the term of this patent is extended or adjusted under 35 U.S.C. 154(b) by 203 days.

(21) Appl. No.: 13/805,086

(22) PCT Filed: Jun. 30, 2010

(86) PCT No.: PCT/CA2010/001024
§ 371 (c)(1),
(2), (4) Date: Feb. 19, 2013

(87) PCT Pub. No.: WO2012/000077
PCT Pub. Date: Jan. 5, 2012

(65) Prior Publication Data
US 2013/0206476 A1 Aug. 15, 2013

(51) Int. Cl.
*E21B 7/12* (2006.01)
*E21B 15/02* (2006.01)
(Continued)

(52) U.S. Cl.
CPC ..... *E21B 15/02* (2013.01); *E21B 7/124* (2013.01); *E21B 19/143* (2013.01); *E21B 25/18* (2013.01); *E21B 41/04* (2013.01)

(58) Field of Classification Search
CPC ..... E21B 7/12; E21B 7/124; E21B 15/02; E21B 19/143
USPC ..... 166/358; 175/5, 6
See application file for complete search history.

(56) References Cited

U.S. PATENT DOCUMENTS 3,643,736 A * 2/1972 Talley, Jr. ..... 166/356
3,741,320 A * 6/1973 Hilfing ..... 175/6
(Continued)

FOREIGN PATENT DOCUMENTS

WO 03093625 11/2003
WO 2005120153 12/2005
WO 2008140883 11/2008

OTHER PUBLICATIONS

Gregg Marine Brochure, Oct. 27, 2009.
(Continued)

*Primary Examiner* — Matthew R Buck
*Assistant Examiner* — Aaron Lembo
(74) *Attorney, Agent, or Firm* — Terrence N. Kuharchuk; Rodman & Rodman LLP

(57) ABSTRACT

A drilling system including a drill head. The drill head defines a drill head bore and includes a drill head bore closure device. An inner core barrel and an inner core barrel retrieval device may be passed through the interior of the drill string and the drill head bore when the drill head is connected with the drill string and the drill head bore closure device is actuated to an open position. A method of wireline core drilling which includes passing an inner core barrel retrieval device through the drill head bore and into the interior of the drill string when the drill head is connected with the drill string, and removing an inner core barrel and the inner core barrel retrieval device from the interior of the drill string through the drill head bore when the drill head is connected with the drill string.

28 Claims, 5 Drawing Sheets

FIG.3

(51) Int. Cl.

| | |
|---|---|
| ***E21B 7/124*** | (2006.01) |
| ***E21B 19/14*** | (2006.01) |
| ***E21B 25/18*** | (2006.01) |
| ***E21B 41/04*** | (2006.01) |

(56) References Cited

U.S. PATENT DOCUMENTS

| | | | | |
|---|---|---|---|---|
| 3,902,553 | A * | 9/1975 | Jergins | 166/352 |
| 4,149,818 | A * | 4/1979 | Hettinger et al. | 405/191 |
| 4,558,744 | A * | 12/1985 | Gibb | 166/335 |
| 4,744,698 | A * | 5/1988 | Dallimer et al. | 405/226 |
| 5,794,716 | A * | 8/1998 | White | 173/189 |
| 6,394,192 | B1 * | 5/2002 | Frazer | 175/58 |
| 7,380,614 | B1 * | 6/2008 | Williamson et al. | 175/6 |
| 7,703,534 | B2 * | 4/2010 | Sheshtawy | 166/358 |
| 8,668,028 | B2 * | 3/2014 | Finkenzeller | 175/7 |
| 8,720,603 | B2 * | 5/2014 | Bauer et al. | 175/6 |
| 8,757,289 | B2 * | 6/2014 | Bauer et al. | 175/6 |
| 2006/0016621 | A1 * | 1/2006 | Jackson et al. | 175/7 |
| 2009/0178847 | A1 * | 7/2009 | Nellessen et al. | 175/5 |
| 2009/0178848 | A1 * | 7/2009 | Nellessen et al. | 175/7 |
| 2010/0119309 | A1 * | 5/2010 | Gibberd | 405/228 |
| 2012/0177447 | A1 * | 7/2012 | Fraenkel et al. | 405/232 |

OTHER PUBLICATIONS

Seabed CPT System Brochure.
GeoDrilling International "Gregg Dives into Deeper Waters for Seabed Testing" Jul./Aug. 2009.
Titan 4 Remote Manipulator System Brochure, 2009.

* cited by examiner

REMOTELY OPERABLE UNDERWATER DRILLING SYSTEM AND DRILLING METHOD

TECHNICAL FIELD

A remotely operable underwater drilling system and a drilling method.

BACKGROUND OF THE INVENTION

Boreholes may be drilled into the ground for many different purposes. One purpose of drilling boreholes is to obtain core samples of the ground through which the drilling is being performed. It may be desirable to obtain core samples in connection with endeavours such as mineral exploration, scientific research, or geotechnical site investigations.

Core drilling for the purpose of obtaining core samples may be performed using a core drill which is located at the lower end of a drill string. The drill string is typically assembled from a plurality of drill rods which are connected together with threaded connections. The lowermost drill rod is known as a core barrel and is comprised of an outer core barrel and an inner core barrel which is secured within the outer core barrel at a drilling position. The core drill is connected with the core barrel and includes an annular cutting surface. The inner core barrel collects a cylindrical core sample from within the annular cut which is made by the annular cutting surface of the core drill. The inner core barrel contains and protects the core sample.

Following the collection of a core sample during core drilling, the inner core barrel must be removed from the interior of the drill string in order to extract the core sample from the inner core barrel, and a replacement inner core barrel must be inserted into the interior of the drill string and secured at the drilling position in order to enable a further core sample to be collected as drilling continues.

In conventional core drilling, the inner core barrel is removed from the interior of the drill string and the replacement inner core barrel is inserted into the interior of the drill string by first removing the entire drill string from the borehole.

In wireline core drilling, the inner core barrel is removed from the interior of the drill string without removing the entire drill string from the borehole, by using an inner core barrel retrieval device such as an overshot which is attached to the end of a wireline. The inner core barrel retrieval device is inserted into the interior of the drill string and passed through the interior of the drill string on the end of the wireline until it attaches with the inner core barrel. The inner core barrel retrieval device and the inner core barrel are then removed from the interior of the drill string by retracting the wireline. The replacement inner core barrel is then inserted into the interior of the drill string and passed through the interior of the drill string until it is secured at the drilling position, either with the wireline or by pumping the replacement inner core barrel through the interior of the drill string with a chaser fluid.

This process of removing an inner core barrel from the interior of the drill string and inserting a replacement inner core barrel into the interior of the drill string may be repeated several times or many times during the drilling of the borehole. As a result, it is apparent that an advantage of wireline core drilling over conventional core drilling is that wireline core drilling does not require the removal of the entire drill string from the borehole each time that the inner core barrel must be removed and replaced.

In the performance of land based conventional or wireline core drilling, it is feasible to carry out core drilling with as few as one or two inner core barrels. If a single inner core barrel is used, drilling must be interrupted while the inner core barrel is removed from the interior of the drill string, while the core sample is extracted from the inner core barrel, and while the inner core barrel is reinserted into the interior of the drill string. If two inner core barrels are used, drilling must be interrupted while the first inner core barrel is removed from the interior of the drill string and while the second core barrel is inserted into the interior of the drill string, but the core sample may be extracted from the first inner core barrel while the second core barrel is being inserted into the interior of the drill string.

The performance of underwater conventional or wireline core drilling involves challenges which are not encountered in the performance of land based core drilling.

For example, underwater core drilling may be performed using drilling equipment which is deployed and controlled from a barge, ship or platform which is located on the surface of a body of water, or may be performed using remotely operable underwater drilling equipment which is operatively connected to a barge, ship or platform with only a deployment cable and/or a control cable.

An advantage of using remotely operable underwater drilling equipment for underwater core drilling is that the underwater equipment is not generally affected by movement of the barge, ship or platform which is located on the surface so that the stability of the underwater equipment is not dependent upon the stability of the surface equipment. As a result, the underwater equipment may typically be constructed to be relatively small and light.

A disadvantage of using remotely operable underwater drilling equipment for underwater core drilling is that although the operation of the underwater equipment may be controlled from a control location on the surface of the body of water, the entire drilling operation must typically be essentially self-contained and performed without physical interaction with the surface.

As one example, underwater drilling equipment must typically carry a supply of drill rods and inner core barrels which is sufficient to enable drilling to a desired depth and the collection of a desired number of core samples. Consequently, a storage area must typically be provided on the underwater drilling equipment for a number of drill rods and inner core barrels.

As a second example, the underwater drilling equipment must be capable of operating remotely without manual adjustment or repair since direct human intervention with the underwater drilling equipment is not typically possible when the equipment is deployed underwater.

As a result, the underwater drilling equipment and its operation are preferably made simple and robust so that an amount of reliability in the underwater environment can be achieved.

U.S. Pat. No. 7,380,614 (Williamson et al) describes a remotely operated water bottom based wireline drilling system and a wireline drilling method.

The wireline drilling system described in U.S. Pat. No. 7,380,614 (Williamson et al) includes a frame, a support structure movably coupled to the frame, a drill head mounted on the support structure, a winch including a cable coupled to the support structure, a latching device located on the end of the cable for latching onto a core barrel, a storage area associated with the frame for drill rods and core barrels, and at least one clamp associated with the frame and arranged to fix a vertical position of a drill string over a drill hole.

The wireline method described in U.S. Pat. No. 7,380,614 (Williamson et al) includes disposing the drilling system on the bottom of a body of water, drilling into a formation which is below the bottom of the body of water by rotating a first drill rod having a first core barrel latched therein and advancing the drill rod longitudinally, opening an upper end of a first drill rod by removing the drill head therefrom by displacing the drill head vertically and/or laterally relative to the upper end of the first drill rod, lowering the cable having the latching device into the first drill rod, retracting the cable to retrieve the first core barrel, laterally displacing the first core barrel from the first drill rod, inserting a second core barrel into the first drill rod and latching it therein, affixing a second drill rod to the upper end of the first drill rod; and resuming drilling the formation by longitudinally advancing and rotating the first and second drill rods. The above method steps may be repeated to include additional core barrels and additional drill rods as drilling progresses.

The wireline drilling system and wireline drilling method described in U.S. Pat. No. 7,380,614 (Williamson et al) do not facilitate or contemplate inserting and/or retrieving a core barrel from the interior of the drill string while the drill head is connected with the drill string.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at a drilling system and a drilling method. The drilling system and drilling method of the invention may be utilized for land based core drilling and/or underwater core drilling, and may be utilized in remotely operable and non-remotely operable embodiments. In some embodiments, the drilling system of the invention may be directed more specifically at a remotely operable underwater drilling system for core drilling. In some embodiments, the drilling method of the invention may be directed more specifically at a remotely operable underwater drilling method for core drilling.

The remotely operable underwater drilling system comprises a drill head and facilitates inserting an inner core barrel and/or an inner core barrel retrieval device into and/or removing an inner core barrel and/or an inner core barrel retrieval device from an interior of a drill string through the drill head while the drill head is connected with the drill string.

In some embodiments, the inner core barrel retrieval device may be associated with a wireline assembly so that the remotely operable underwater drilling system may be described as a wireline core drilling system. In some embodiments, the wireline assembly may be comprised of a winch, a winch cable and the inner core barrel retrieval device.

The drilling method comprises inserting an inner core barrel and/or an inner core barrel retrieval device into and/or removing an inner core barrel and/or an inner core barrel retrieval device from an interior of a drill string through a drill head of a drilling system while the drill head is connected with the drill string.

In some embodiments, the inner core barrel retrieval device may be associated with a wireline assembly so that the drilling method may be described as a wireline core drilling method. In some embodiments, the wireline assembly may be comprised of a winch, a winch cable and the inner core barrel retrieval device.

In an apparatus aspect, the invention is a remotely operable underwater drilling system for use with a drill string comprising at least one drill rod and for use with an inner core barrel which is adapted to be contained within an interior of the drill string, the drilling system comprising:

(a) a frame;

(b) a deployment connector attached to the frame, for connecting the drilling system with a deployment cable so that the drilling system may be suspended from the deployment cable in a body of water;

(c) an adjustable support mechanism attached to the frame, for enabling the drilling system to be supported on an underwater ground surface at a substantially level orientation;

(d) a mast structure mounted on the frame, wherein the mast structure defines a drilling axis for the drill string;

(e) a drill head mounted on the mast structure such that the drill head is aligned with the drilling axis and longitudinally reciprocable along the drilling axis, wherein the drill head has an upper drill head end and a lower drill head end, wherein the drill head defines a drill head bore extending fully through the drill head from the upper drill head end to the lower drill head end, wherein the drill head bore is substantially coaxial with the drilling axis, and wherein the drill head is comprised of:

(i) a drill head connector for connecting the drill head with the drill string along the drilling axis; and (ii) a drill head bore closure device adjacent to the upper drill head end, wherein the drill head bore closure device is actuatable between a closed position in which the drill head bore is closed and an open position in which the drill head bore is open, and wherein the inner core barrel may be inserted into and removed from the interior of the drill string through the drill head bore when the drill head is connected with the drill string and the drill head bore closure device is actuated to the open position; and (f) a clamping mechanism mounted on the mast structure, for supporting the drill string along the drilling axis when the drill head is not connected with the drill string.

The drill head may be comprised of any drill head which is suitable for core drilling and which is capable of incorporating the features of the invention.

In some embodiments, the drill head may be mounted on the mast structure so that the drill head is fixedly aligned with the drilling axis and is therefore incapable of being moved out of alignment with the drilling axis, thereby reducing the number of movements which must be performed by the drill head.

The clamping mechanism may be comprised of a single clamp or may be comprised of a plurality of clamps. In some embodiments, the clamping mechanism may be comprised of an upper clamp and a lower clamp. In some embodiments, the upper clamp and the lower clamp may be separated by a longitudinal clamp gap. In some embodiments, at least one of the upper clamp and the lower clamp may be rotatable. In some embodiments, the upper clamp may be rotatable. In some embodiments, the lower clamp may be non-rotatable.

In some embodiments, the drilling system may be further comprised of a casing clamp for supporting a casing in a borehole as the borehole is being formed by the drilling system. In some embodiments, the casing clamp may be mounted on the mast structure. The casing clamp may be comprised of any structure, device or apparatus which is suitable for supporting a casing. In some embodiments, the casing clamp may be comprised of a clamping device which may be similar in structure and operation to a clamp of the type which may be included in the clamping mechanism.

In some embodiments, the drilling system may be further comprised of a centralizer for assisting in aligning a drill rod with the drilling axis when a drill rod is presented to the drilling axis. In some embodiments, the centralizer may be mounted on the mast structure. In some embodiments, the centralizer may be comprised of a guiding surface, for guiding the drill rod into alignment with the drilling axis. In some embodiments, the guiding surface may be comprised of a cone-shaped surface. In some embodiments, the centralizer may be comprised of a clamping device which is aligned with the drilling axis and which is capable of clamping a drill rod gently so that it may be aligned with the drilling axis. In some embodiments, the clamping device may be comprised of clamping surfaces which are constructed of a material which is capable of clamping a drill rod without damaging the drill rod. In some embodiments, the centralizer may be comprised of a combination of a guiding surface and a clamping device.

The drill head connector may be comprised of any structure, device or apparatus which is suitable for connecting the drill head with the drill rod and the drill string. In some embodiments, the drill head connector may be comprised of a threaded connector for providing a threaded connection between the drill head and the drill rod. In some embodiments, the drill head may be further comprised of a drill head chuck for providing a friction connection between the drill head and the drill rod. In some embodiments, the drill head chuck may be used to connect the drill head with the drill rod and the drill string temporarily in order to facilitate the assembly and/or disassembly of the drill string, and the drill head connector may be used to connect the drill head with the drill rod and the drill string more permanently to facilitate drilling.

The drill head bore closure device may be comprised of any device which is actuatable between a closed position in which the drill head bore is closed and an open position in which the drill head bore is open. In some embodiments, the drill head bore closure device may be integral with the drill head. In some embodiments, the drill head bore closure device may be a component which is permanently or removably connected with the drill head.

In some embodiments, the drill head bore closure device may be comprised of a valve. In some embodiments, the drill head bore closure device may be comprised of a ball valve.

In some embodiments, the drilling system may be configured so that an inner core barrel retrieval device may be inserted into and removed from the interior of the drill string through the drill head bore when the drill head is connected with the drill string and the drill head bore closure device is actuated to the open position. In some embodiments, the inner core barrel retrieval device may be comprised of a latching device for latching onto the inner core barrel.

In some embodiments, the drilling system may be further comprised of a guiding surface located at the upper drill head end, for guiding the inner core barrel and/or the inner core barrel retrieval device into the drill head bore.

The guiding surface may be comprised of any structure, device and/or shape which is suitable for guiding the inner core barrel and/or the inner core barrel retrieval device into the drill head bore. In some embodiments, the guiding surface may be comprised of a cone-shaped surface which surrounds the drill head bore at the upper drill head end. In some embodiments, the cone-shaped surface may be provided by a structure or device which is located at the upper drill head end. In some embodiments, the cone-shaped surface may be defined by the drill head at the upper drill head end.

In some embodiments, the drilling system may be further comprised of a storage area for storing a plurality of the drill rods and a plurality of the inner core barrels. In some embodiments, the storage area may be defined by the frame.

The storage area may be comprised of any area on or within the drilling system which is suitable for storing a plurality of the drill rods and a plurality of the inner core barrels. For example, the storage area may be configured as a storage bin or as a storage carousel.

In some embodiments, the storage area may be configured so that the drill rods and/or the inner core barrels are stored substantially vertically in the storage area.

In some embodiments, the storage area may be comprised of a plurality of storage rows. In some embodiments, a plurality of the storage rows may be provided for the drill rods and a plurality of the storage rows may be provided for the inner core barrels. In some embodiments, a single storage row may be provided for the drill rods. In some embodiments, the single storage row which is provided for the drill rods may provide a single storage section for the drill rods.

In some embodiments, the storage area may provide individual storage positions for each of the drill rods and/or each of the inner core barrels. The individual storage positions may be provided in any suitable manner. In some embodiments, the individual storage positions may be provided by a plate which is positioned substantially horizontally in the storage area, wherein the plate defines holes which are sized to accommodate individual drill rods and/or inner core barrels.

In some embodiments, the individual storage positions may be provided in the storage rows so that the storage rows are comprised of individual storage positions for the drill rods and/or the inner core barrels.

In some embodiments, the storage area may facilitate arranging the inner core barrels in the storage area so that the order in which the inner core barrels has been used can be determined from the positions of the inner core barrels in the storage area. In some embodiments, the storage area may facilitate arranging the inner core barrels by providing a plurality of the storage rows for the inner core barrels. In some embodiments, the storage area may facilitate arranging the inner core barrels by providing at least one more storage row than is necessary to hold all of the inner core barrels which are to be used in the performance of the drilling, so that the inner core barrels may be returned to different storage rows in the storage area after use than the storage rows in which the inner core barrels were stored before use.

In some embodiments, the drilling system may be further comprised of an intermediate storage area for temporarily storing drill rods and/or inner core barrels. In some embodiments, the intermediate storage area may be located between the drilling axis and the storage area.

In some embodiments, the drilling system may be further comprised of a handling device for moving the drill rods and/or the inner core barrels between the storage area and the drilling axis.

The handling device may be comprised of any structure, device or apparatus which is suitable for moving the drill rods and/or the inner core barrels. In some embodiments, the handling device may be comprised of a handling arm.

In some embodiments, the handling device may have a vertical handling device axis and the handling arm may be rotatable in a horizontal plane about the vertical handling device axis.

In some embodiments, the storage area may be comprised of a plurality of storage rows for drill rods and/or inner core barrels, wherein the plurality of storage rows are arranged as spokes extending radially along storage row lines which substantially intersect with the vertical handling device axis. In some embodiments, the storage area may be described as a non-rotating storage carousel comprising radial storage rows.

In some embodiments, the handling arm may be extendible and retractable radially relative to the vertical handling device axis.

In some embodiments, the handling aim may be comprised of a gripping device for gripping drill rods and/or inner core barrels. The gripping device may be comprised of any device which is suitable for gripping the drill rods and/or the inner core barrels. In some embodiments, the gripping device may be vertically movable in order to raise and lower the gripping device.

The handling device, including the handling arm and the gripping device, may be comprised of any structure, device or apparatus or combination of structures, devices and apparatus which is capable of accommodating the required movements of the handling device, the handling arm and the gripping device.

In some embodiments, components of the handling device may be telescoping in order to accommodate the required movements of the handling arm. In some embodiments, the handling device may be comprised of one or more articulating joints and components of the handling device may articulate in order to accommodate the required movements of the handling arm. In some embodiments, components of the handling device may be rotatable in order to accommodate the required movements of the handling arm. In some embodiments, the required movements of the handling arm may be accommodated by a combination of features of the handling device.

In some embodiments, the handling device may be a remotely operable manipulator device. In some embodiments a suitable remotely operable manipulator device may be a TITAN 4™ manipulator system manufactured by Schilling Robotics, LLC of Davis, Calif.

In some embodiments, the storage area may be comprised of a plurality of storage areas. In some embodiments, the storage area may be comprised of a first storage area and a second storage area. In some embodiments, the first storage area and the second storage area may be arranged so that the drilling system is substantially balanced when the first storage area and the second storage are filled with drill rods and inner core barrels. In some embodiments, the first storage area may be located on a first side of the drilling system and the second storage area may be located on a second side of the drilling system.

In some embodiments, the mast structure may be movable between a collapsed position and an upright position. In some such embodiments, the mast structure may be movable between the collapsed position and the upright position by pivoting relative to the frame. In some embodiments, the mast structure may be fixed in the upright position.

The drilling system may be remotely operable in any suitable manner. The drilling system may be remotely operable from a control location In some embodiments, the drilling system may be preprogrammed before being deployed in the body of water so that the drilling system is remotely controlled by preprogrammed commands.

In some embodiments, the drilling system may be remotely operable from a control location. The control location may be any location which is remote from the drilling system. The drilling system may be operably connected with the control location in any suitable manner.

In some embodiments, the drilling system may be operably connected with the control location using a wireless communication system. In some embodiments, the drilling system may be controlled using a communication system which is physically connected between the drilling system and a control location. In some embodiments, a combination of communication systems may be used to operably connect the drilling system with the control location.

In some embodiments, the drilling system may be further comprised of a control cable for operably connecting the drilling system with the control location. In some embodiments, the control cable may be separate from the deployment cable. In some embodiments, the control cable may be connected with or otherwise associated with the deployment cable. In some embodiments, the control cable and the deployment cable may be comprised of a single cable structure or assembly.

The adjustable support mechanism may be comprised of any structure, device or apparatus which is suitable for leveling the drilling system on the underwater ground surface. In some embodiments, the adjustable support mechanism may be comprised of a plurality of support legs. In some embodiments, at least one of the support legs may be adjustable in order to level the drilling system on the underwater ground surface.

In a method aspect, the invention is a method of drilling, the method comprising:

(a) providing a drilling system, wherein the drilling system is comprised of a drill head, wherein the drill head has an upper drill head end and a lower drill head end, and wherein the drill head defines a drill head bore extending fully through the drill head from the upper drill head end to the lower drill head end;

(b) positioning the drill head so that the drill head is aligned with a drilling axis defined by the drilling system;

(c) connecting the drill head with a drill string, wherein the drill string is comprised of a first inner core barrel secured at a drilling position within an interior of the drill string;

(d) drilling by actuating the drill head and longitudinally advancing the drill head along the drilling axis;

(e) passing an inner core barrel retrieval device through the drill head bore and into the interior of the drill string while the drill head is connected with the drill string;

(f) attaching the first inner core barrel with the inner core barrel retrieval device in the interior of the drill string; and (g) removing the first inner core barrel and the inner core barrel retrieval device from the interior of the drill string through the drill head bore while the drill head is connected with the drill string.

Actuating the drill head may be performed in any manner which is suitable for the drill head which is being used for drilling. In some embodiments, actuating the drill head results in rotating of the drill string in order to facilitate drilling. In some embodiments, the drill head may be comprised of a sonic drill head, and actuating the drill head may result in the addition of a sonic effect in order to facilitate or enhance drilling.

In some embodiments, the method may be further comprised of passing a second inner core barrel through the drill head bore and into the interior of the drill string while the drill string is connected with the drill string.

In some embodiments, the method may be further comprised of closing the drill head bore after passing the second inner core barrel through the drill head bore and into the interior of the drill string. In some embodiments, closing the drill head bore may be comprised of actuating a drill head bore closure device to a closed position.

In some embodiments, the method may be further comprised of pumping a fluid through the drill string in order to move the second inner core barrel through the interior of the drill string and in order to secure the second inner core barrel at the drilling position.

In some embodiments, the method may be further comprised of disconnecting the drill head from the drill string while supporting the drill string with a clamping mechanism associated with the drilling system.

The clamping mechanism may be comprised of a single clamp or may be comprised of a plurality of clamps. In some embodiments, the clamping mechanism may be comprised of an upper clamp and a lower clamp. In some embodiments, the upper clamp and the lower clamp may be separated by a longitudinal clamp gap. In some embodiments, at least one of the upper clamp and the lower clamp may be rotatable. In some embodiments, the upper clamp may be rotatable. In some embodiments, the lower clamp may be non-rotatable.

In some embodiments, the method may be further comprised of lengthening the drill string by interconnecting a drill rod between the drill head and an upper end of the drill string while the drill string is supported with the clamping mechanism.

Interconnecting the drill rod between the drill head and the upper end of the drill string may be performed in any manner which is suitable having regard to the drilling system which is being used.

In some embodiments, interconnecting the drill rod between the drill head and the upper end of the drill string may be comprised of moving the drill rod from a storage area to the drilling axis with a handling device.

In some embodiments, the handling device may be comprised of a handling arm. In some embodiments, the handling device may have a vertical handling device axis and the handling arm may be rotatable in a horizontal plane about the vertical handling device axis.

In some embodiments, the storage area may be comprised of a plurality of storage rows. In some embodiments, the plurality of storage rows may be arranged as spokes extending radially along storage row lines which substantially intersect with the vertical handling device axis.

In some embodiments, moving the drill rod from the storage area to the drilling axis with the handling device may be comprised of selecting the drill rod from one of the storage rows and rotating the handling arm about the vertical handling device axis in order to move the drill rod to the drilling axis.

In some embodiments, the handling arm may be extendible and retractable relative to the vertical handling device axis.

In some embodiments, selecting the drill rod from one of the storage rows may be comprised of extending the handling arm toward the storage row. In some embodiments, moving the drill rod to the drilling axis may be comprised of extending the handling arm toward the drilling axis.

In some embodiments, the handling arm may be comprised of a gripping device. In some embodiments, the gripping device may be vertically movable in order to raise and lower the gripping device.

In some embodiments, moving the drill rod from the storage area to the drilling axis may be comprised of vertically moving the gripping device in order to present the drill rod between the drill head and the upper end of the drill string.

In some embodiments, interconnecting the drill rod between the drill head and the upper end of the drill string may be further comprised of moving the drill head longitudinally along the drilling axis toward the drill rod so that a drill head connector associated with the drill head engages with the drill rod. In some embodiments, interconnecting the drill rod between the drill head and the upper end of the drill string may be further comprised of moving the drill rod longitudinally along the drilling axis toward the drill head and/or the upper end of the drill string with the handling device so that the drill rod engages with the drill head connector and/or the upper end of the drill string. In some embodiments, interconnecting the drill rod between the drill head and the upper end of the drill string may be further comprised of longitudinally moving both the drill head and the drill rod longitudinally along the drilling axis.

The drill head connector may be comprised of any structure, device or apparatus which is suitable for connecting the drill head with the drill rod and the drill string. In some embodiments, the drill head connector may be comprised of a threaded connector for providing a threaded connection between the drill head and the drill rod. In some embodiments, the drill head may be further comprised of a drill head chuck for providing a friction connection between the drill head and the drill rod. In some embodiments, the drill head chuck may be used to connect the drill head with the drill rod and the drill string temporarily in order to facilitate the assembly and/or disassembly of the drill string, and the drill head connector may be used to connect the drill head with the drill rod and the drill string more permanently to facilitate drilling.

In some embodiments, interconnecting the drill rod between the drill head and the upper end of the drill string may be further comprised of actuating the drill head to rotate the drill head connector in order to threadably connect the drill rod with the drill head connector and/or with the upper end of the drill string. In some embodiments, interconnecting the drill rod between the drill head and the upper end of the drill string may be further comprised of actuating the clamping mechanism to rotate the clamping mechanism in order to threadably connect the drill rod with the drill head connector and/or the upper end of the drill string. In some embodiments, interconnecting the drill rod between the drill head and the upper end of the drill string may be further comprised of actuating both the drill head and the clamping mechanism in order to threadably connect the drill rod with the drill head connector and/or the upper end of the drill string.

In some embodiments, the method may be further comprised of drilling, after lengthening the drill string, by actuating the drill head and longitudinally advancing the drill head along the drilling axis.

BRIEF DESCRIPTION OF DRAWINGS

Embodiments of the invention will now be described with reference to the accompanying drawings, in which:

FIGS. 2A, 2B and 2C collectively are a schematic longitudinal section drawing of a drill rod, an outer core barrel, an inner core barrel, a coring drill bit, and an inner core barrel retrieval device of a type which may be used with the invention, wherein FIG. 2B is an extension of FIG. 2A and FIG. 2C is an extension of FIG. 2B.

DETAILED DESCRIPTION

In some embodiments, the present invention is directed at a remotely operable underwater drilling system for core drilling and at a drilling method for core drilling. In other embodiments, the present invention may be directed at either land based core drilling or underwater core drilling, and may be directed at either remotely operable or non-remotely operable core drilling.

Figure 1:
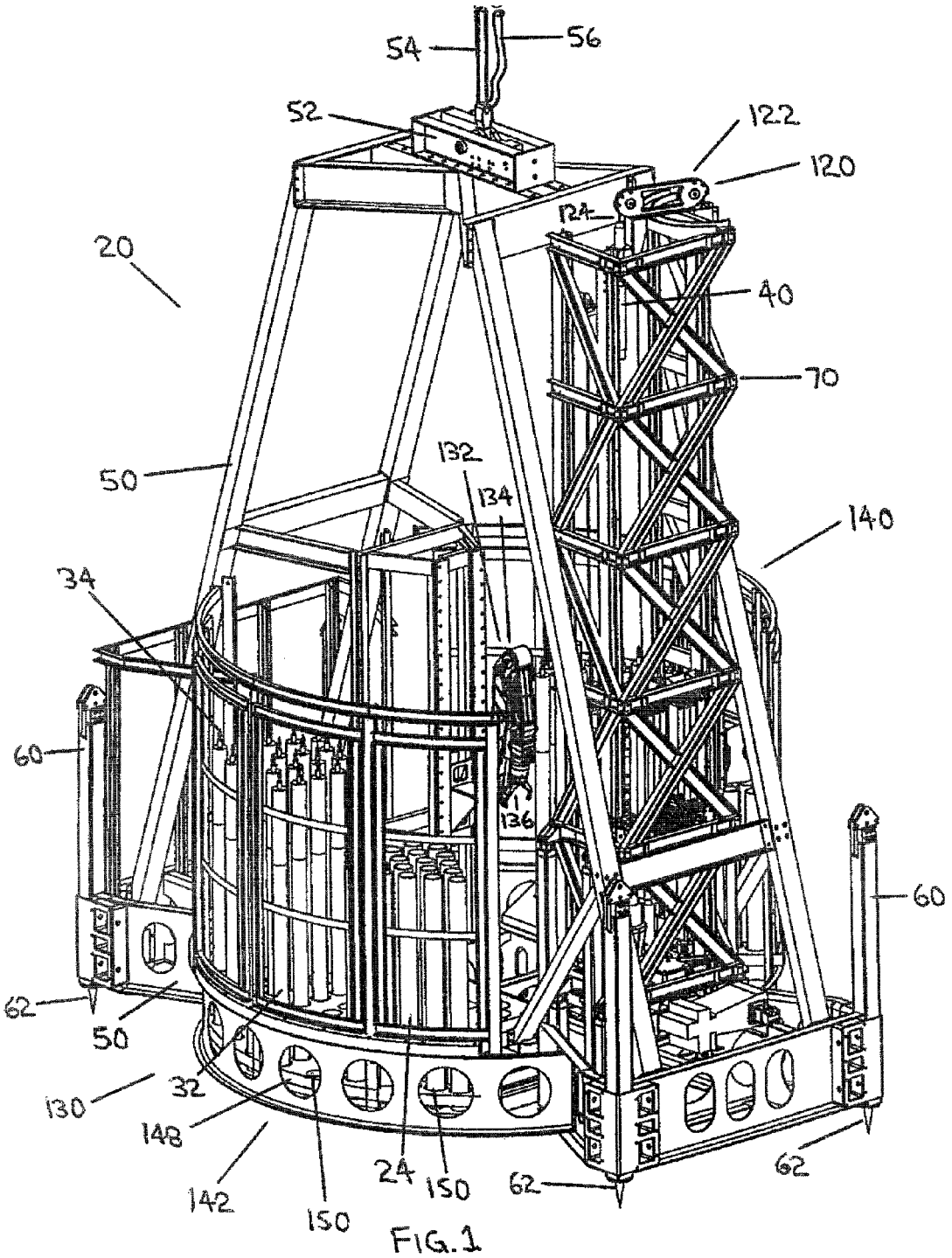
FIG. 1 is a pictorial view of an exemplary embodiment of a drilling system according to the invention.

Referring to FIG. 1, there is depicted a particular exemplary embodiment, according to the invention, of a drilling system (20) for core drilling. In the exemplary embodiment depicted in FIG. 1, the drilling system (20) is configured so that it may be operated remotely from a control location (not shown). In the exemplary embodiment depicted in FIG. 1, many of the components of the drilling system (20) are powered and/or actuated by one or more hydraulic systems which are included in the drilling system (20). In other embodiments, other types of systems, including but not limited to electrical systems, may be used to power and/or actuate the drilling system (20).

The drilling system (20) is configured to be connected with a drill string (22) in order to drill a coring borehole (not shown).

Figure 2A:
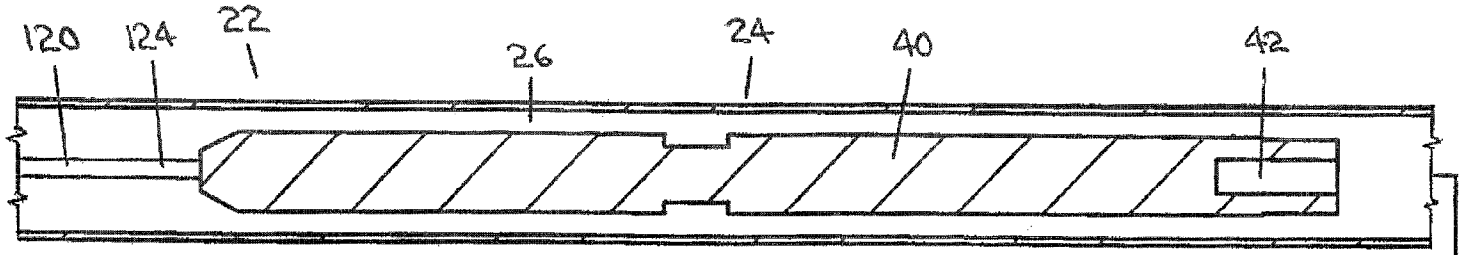
Figure 2B:
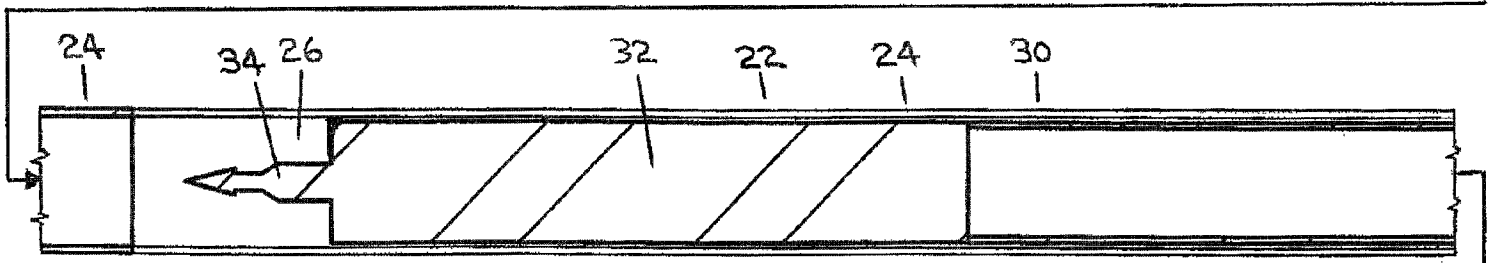
Figure 2C:
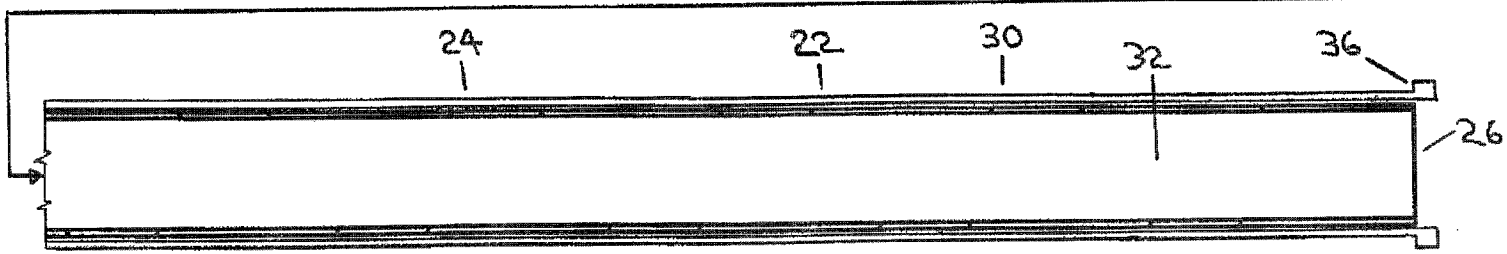

Referring to FIG. 2A, FIG. 2B and FIG. 2C, the drill string (22) is comprised of one or more drill rods (24) which are connected together end to end. Each of the drill rods (24) is comprised of a hollow conduit having a threaded connector at each end so that the drill rods (24) may be threaded together to form the drill string (22). In the exemplary embodiment, the drill rods (24) which are used with the drilling system (20) may typically have a length of about 2 meters. The drill string (22) has an interior (26).

The distal or lowermost drill rod (24) is an outer core barrel (30). During drilling, an inner core barrel (32) is releasably secured within the outer core barrel (30) at a drilling position within the outer core barrel (30). The inner core barrel (32) is comprised of a fishing neck (34). A coring drill bit (36) is attached to the lower end of the outer core barrel (30).

The fishing neck (34) is configured to be engaged by a inner core barrel retrieval device (40). The inner core barrel retrieval device (40) is typically comprised of a latching device (42) for latching onto the fishing neck (34) on the inner core barrel (32). The inner core barrel retrieval device (40) may be referred to as an "overshot" device.

The inner core barrel (28) and the inner core barrel retrieval device (40) are configured so that they may be passed through the interior (26) of the drill string (22) in order to facilitate wireline core drilling.

In the exemplary embodiment depicted in FIG. 1, the drilling system (20) is comprised of a frame (50). The frame (50) is constructed as a porous framework comprising structural members so that the frame (50) will displace a minimum amount of water as the frame (50) passes through water. The frame (50) carries and supports the other components of the drilling system (50) as an integrated system.

In the exemplary embodiment depicted in FIG. 1, a deployment connector (52) is attached to the frame (50) at an upper end of the frame (50). The deployment connector (52) enables the drilling system (20) to be connected with a deployment cable (54) so that the drilling system (20) may be suspended from the deployment cable (54) in a body of water (not shown).

In the exemplary embodiment depicted in FIG. 1, the drilling system (20) is operably connected with the control location with a control cable (56). In the exemplary embodiment depicted in FIG. 1, the control cable (56) is associated with the deployment cable (54) so that the control cable (56) may be deployed with the deployment cable (54) and so that the control cable (56) may be supported and protected by the deployment cable (54).

In the exemplary embodiment depicted in FIG. 1, an adjustable support mechanism (60) is attached to the frame (50) at a lower end of the frame (50). The adjustable support mechanism (60) enables the drilling system (20) to be supported on an underwater ground surface (not shown) at a substantially level orientation. The adjustable support mechanism (60) is comprised of four support legs (62). In the exemplary embodiment depicted in FIG. 1, each of the four support legs (62) is adjustable in order to level the drilling system (20). In the exemplary embodiment, the support legs (62) are actuated hydraulically and remotely in order to adjust the length of the support legs (62).

In the exemplary embodiment depicted in FIG. 1, a mast structure (70) is mounted on the frame (50). The mast structure (70) defines a drilling axis (72). In the exemplary embodiment depicted in FIG. 1, the mast structure (70) is fixed in an upright position relative to the frame (50). In FIG. 1, the mast structure (70) is depicted in the fixed upright position.

In some alternate embodiments, the mast structure (70) may be movable between a collapsed position and the upright position. In some such embodiments, the mast structure (70) may be movable between the collapsed position and the upright position by pivoting relative to the frame (50). In some such embodiments, the mast structure (70) may be actuated hydraulically and remotely in order to pivot the mast structure (70) and move the mast structure (70) between the collapsed position and the upright position.

In the exemplary embodiment depicted in FIG. 1, a drill head (80) is mounted on the mast structure (70). In the exemplary embodiment depicted in FIG. 1, the drill head (80) is mounted on the mast structure (70) such that the drill head (80) is fixedly aligned with the drilling axis (72) and such that the drill head (80) is longitudinally reciprocable along the drilling axis (72). The drill head (80) is actuated hydraulically and remotely in order to move the drill head (80) longitudinally along the drilling axis (72).

Figure 7:
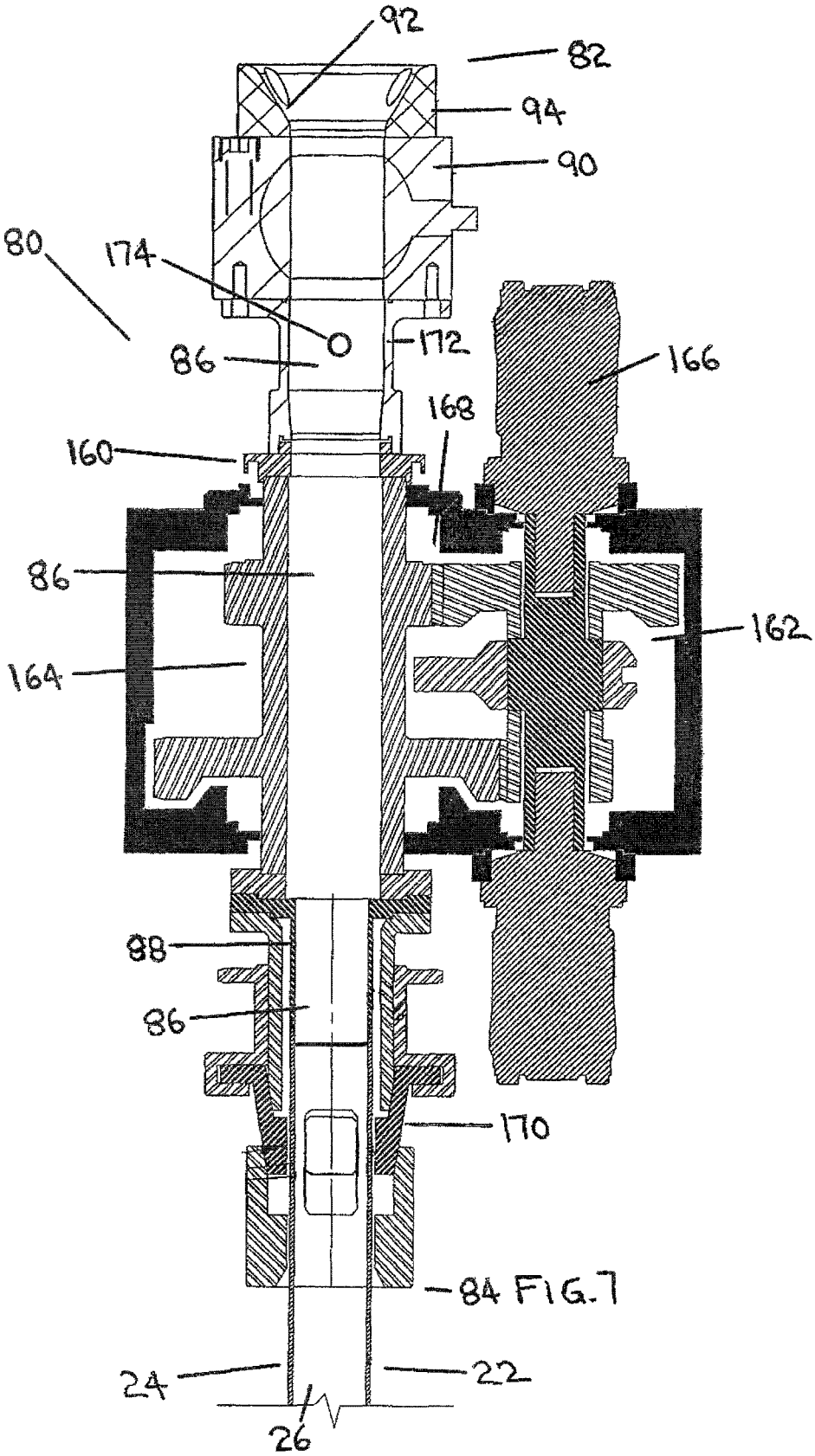
FIG. 7 is a schematic longitudinal section assembly drawing of a drill head for the exemplary embodiment of the drilling system which is depicted in FIG. 1.

Referring to FIG. 7, the drill head (80) has an upper drill head end (82) and a lower drill head end (84). The drill head (80) defines a drill head bore (86) which extends fully through the drill head (80) from the upper drill head end (82) to the lower drill head end (84). The drill head bore (86) is substantially coaxial with the drilling axis (72).

In the exemplary embodiment depicted in FIG. 1 and as depicted in FIG. 7, the drill head (80) is comprised of a drill head connector (88) for connecting the drill head (80) with the drill string (22) along the drilling axis (72). In the exemplary embodiment as depicted in FIG. 7, the drill head connector (88) is comprised of a threaded connector for providing a threaded connection between the drill head (80) and the drill string (22).

In the exemplary embodiment depicted in FIG. 1 and as depicted in FIG. 7, the drill head (80) is further comprised of a drill head bore closure device (90) for selectively closing the drill head bore (86). The drill head bore closure device (90) is located adjacent to the upper drill head end (82).

The drill head bore closure device (90) is actuatable between a closed position in which the drill head bore (86) is closed and an open position in which the drill head bore (86) is open. When the drill head (80) is connected with a drill string (22) and the drill head bore closure device (90) is actuated to the open position, the inner core barrel (32) and/or the inner core barrel retrieval device (40) may be inserted into and removed from the interior (26) of the drill string (22) through the drill head bore (86).

In the exemplary embodiment depicted in FIG. 1 and as depicted in FIG. 7, the drill head bore closure device (90) is comprised of a valve. More specifically, in the exemplary embodiment as depicted in FIG. 7, the drill head bore closure device (90) is comprised of a ball valve assembly. In the exemplary embodiment as depicted in FIG. 7, the ball valve assembly is provided as a removable component of the drill head (80) which is mounted at the upper drill head end (82). In the exemplary embodiment as depicted in FIG. 7, the ball valve assembly is actuated hydraulically and remotely.

In the exemplary embodiment depicted in FIG. 1 and as depicted in FIG. 7, a guiding surface (92) is located at the upper drill head end (82), for guiding the inner core barrel (32) and the inner core barrel retrieval device (40) into the drill head bore. In the exemplary embodiment as depicted in FIG. 7, the guiding surface (92) is comprised of a cone-shaped surface which surrounds the drill head bore (86) at the upper drill head end (82). In the exemplary embodiment as depicted in FIG. 7, the cone-shaped surface is defined by a guiding collar (94) which is either attached to the upper end of the ball valve assembly or integrally formed with the ball valve assembly.

Figure 4:
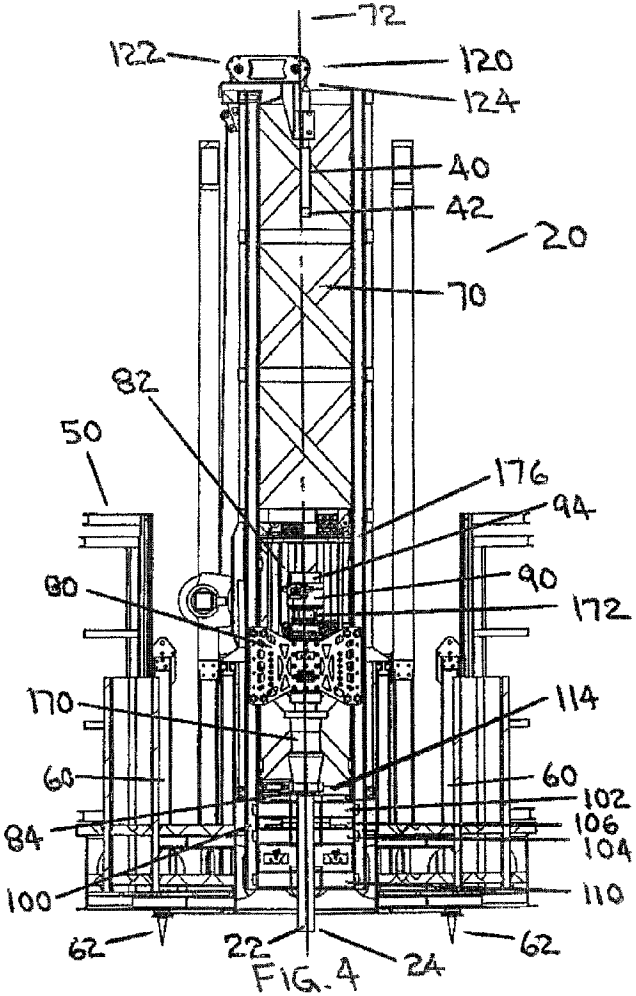
FIG. 4 is a section view of the exemplary embodiment of the drilling system which is depicted in FIG. 1, taken along section line 4-4 in FIG. 3.
Figure 3:
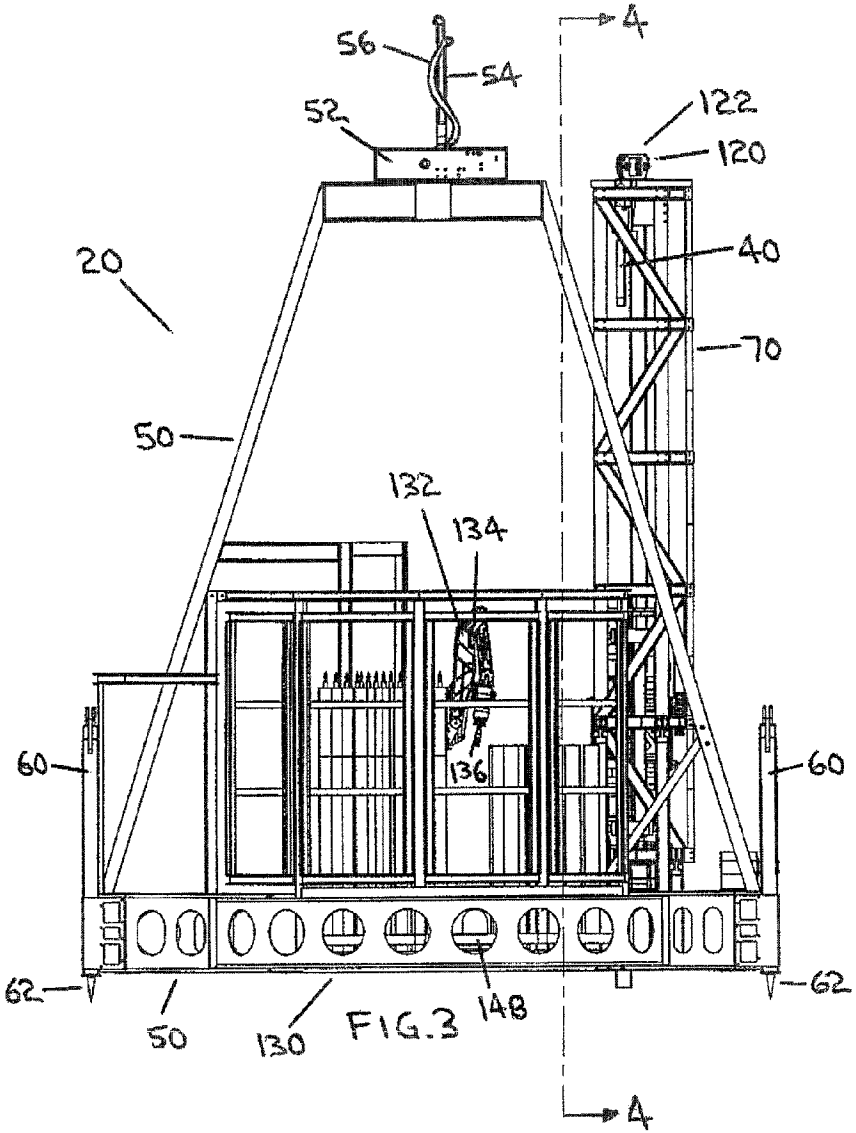
FIG. 3 is a side view of the exemplary embodiment of the drilling system which is depicted in FIG. 1.

Referring to FIG. 4, in the exemplary embodiment depicted in FIG. 1, a clamping mechanism (100) is mounted on the mast structure (70). The clamping mechanism (100) is capable of selectively supporting the drill string (22) along the drilling axis (72) when the drill head (80) is not connected with the drill string (22). In the exemplary embodiment as depicted in FIG. 4, the clamping mechanism (100) is actuated hydraulically and remotely in order to selectively clamp onto the drill string (22) or release the drill string (22).

In the exemplary embodiment depicted in FIG. 1 and as depicted in FIG. 4, the clamping mechanism (100) is comprised of an upper clamp (102) and a lower clamp (104). The upper clamp (102) and the lower clamp (104) are separated by a longitudinal clamp gap (106). In the exemplary embodiment as depicted in FIG. 4, the upper clamp (102) is rotatable by about 30 degrees and the lower clamp (104) is non-rotatable. In the exemplary embodiment, the upper clamp (102) is actuated hydraulically and remotely in order to rotate the upper clamp (102) and thus rotate the drill string (22) when the drill string (22) is clamped and supported by the upper clamp (102).

Referring to FIG. 4, in the exemplary embodiment depicted in FIG. 1, a casing clamp (110) is mounted on the mast structure (70). The casing clamp (110) is aligned with the drilling axis (72). The purpose of the casing clamp (110) is to support a casing (not shown) in a borehole (not shown) as the borehole is being formed by the drilling system (20). The purpose of the casing is to line the borehole during drilling in order to prevent collapse of the borehole. The casing has a larger diameter than the drill string (22) so that the drill string (22) may be received within and pass through the casing. Typically, the casing will be comprised of a single length or joint of casing which is intended only to line the upper portion of the borehole.

Referring to FIG. 4, in the exemplary embodiment depicted in FIG. 1, a centralizer (114) is mounted on the mast structure (70). The purpose of the centralizer (114) is to assist in aligning a drill rod (24) with the drilling axis (72) when the drill rod (24) is being added to the drill string (22). In the exemplary embodiment as depicted in FIG. 4, the centralizer (114) is comprised of a clamping device which is aligned with the drilling axis (72) and which is actuated hydraulically and remotely in order to clamp the drill rod (24) gently so that it is aligned with the drilling axis (72). In the exemplary embodiment depicted in FIG. 1, the clamping device is comprised of clamping surfaces which are constructed of a material which is capable of clamping the drill rod (24) without damaging the drill rod (24). In the exemplary embodiment depicted in FIG. 1, the centralizer (114) is further comprised of a cone-shaped guiding surface which is defined by the clamping surfaces.

Referring to FIG. 1 and FIG. 4, in the exemplary embodiment depicted in FIG. 1, the inner core barrel retrieval device (40) is a component of a wireline assembly (120). The wireline assembly (120) is comprised of a winch (122) which is attached to the frame (50), a winch cable (124) which is attached to the winch (122), and the inner core barrel retrieval device (40), which is attached to the winch cable (124). The wireline assembly (120) facilitates wireline core drilling by enabling the inner core barrel retrieval device (40) to be inserted into and removed from the interior (26) of the drill string (22) using the winch (122) and the winch cable (124).

Figure 5:
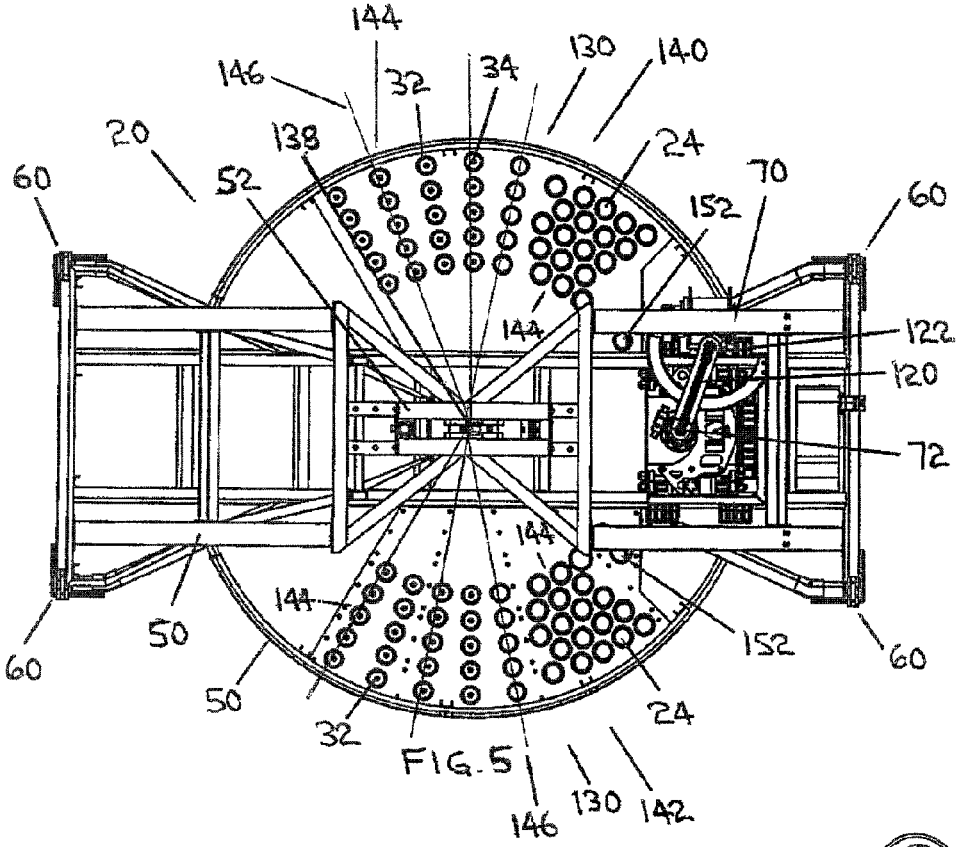
FIG. 5 is a plan view of the exemplary embodiment of the drilling system which is depicted in FIG. 1.

Referring to FIG. 5, in the exemplary embodiment depicted in FIG. 1, the drilling system (20) is further comprised of a storage area (130) for storing a plurality of the drill rods (24) and a plurality of the inner core barrels (32) and a handling device (132) for moving the drill rods (24) and the inner core barrels (32) between the storage area (130) and the drilling axis (72). In the exemplary embodiment as depicted in FIG. 5, the storage area (130) is configured to store the drill rods (24) and the inner core barrels (32) substantially vertically.

Figure 6:
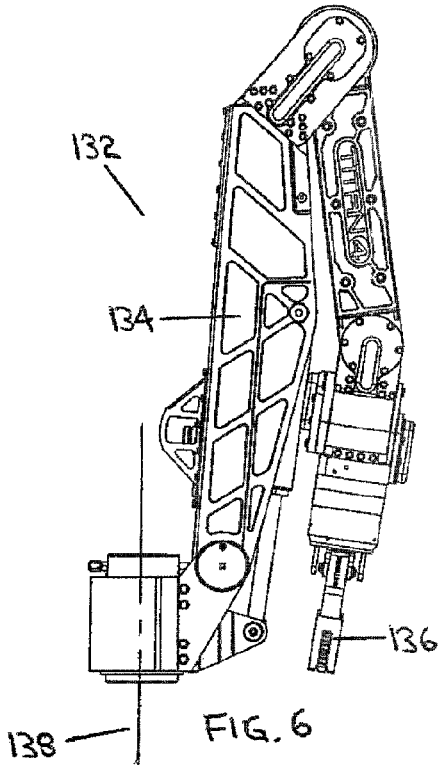
FIG. 6 is a side view of a handling device for the exemplary embodiment of the drilling system which is depicted in FIG. 1.

Referring to FIG. 1 and FIG. 6, in the exemplary embodiment as depicted in FIG. 1, the handling device (132) is comprised of a handling arm (134) which is mounted on the frame (50). The handling arm (134) is comprised of a gripping device (136) for gripping drill rods (24) and inner core barrels (32). The handling device (132) has a vertical handling device axis (138). The handling arm (134) is rotatable in a horizontal plane about the vertical handling device axis (138). The handling arm (134) is also extendible and retractable radially relative to the vertical handling device axis (138). The gripping device (136) is also vertically movable in order to raise and lower the gripping device (136).

In the exemplary embodiment depicted in FIG. 1, the handling device (132) is actuated hydraulically and remotely in order to perform the movements of the handling device (132). In the exemplary embodiment, the handling device is comprised of a TITAN 4™ manipulator system manufactured by Schilling Robotics, LLC of Davis, Calif.

In the exemplary embodiment depicted in FIG. 1 and as depicted in FIG. 5, the storage area (130) is comprised of a first storage area (140) and a second storage area (142) which are defined by the frame (50). The first storage area (140) and the second storage area (142) are arranged on the frame (50) so that the drilling system (20) is substantially balanced when the first storage area (140) and the second storage area (142) are filled with drill rods (24) and inner core barrels (320. More specifically, in the exemplary embodiment, the first storage area (140) and the second storage area (142) are located on opposite sides of the frame (50) so that they essentially "mirror" each other, and the handling device (132) is located between the first storage area (140) and the second storage area (142).

In the exemplary embodiment depicted in FIG. 1 and as depicted in FIG. 5, the first storage area (140) and the second storage area (142) are each comprised of a plurality of storage rows (144). In particular, a plurality of storage rows (144) is provided in each of the storage areas (140,142) for the inner core barrels (32) and a single storage row (144) is provided in each of the storage areas (140,142) for the drill rods (24). The plurality of storage rows (144) are arranged as spokes extending radially along storage row lines (146) which substantially intersect with the vertical handling device axis (138).

The single storage row (144) which is provided for the drill rods (24) in each of the storage areas (140,142) is sufficiently wide and deep to accommodate one half of the drill rods (24) which are expected to be used during drilling. Since it is normally not necessary to identify a particular drill rod (24) during or after drilling, the drill rods (24) may be intermingled in a single storage row (144) which essentially provides a storage section for the drill rods (24). As a result, in the exemplary embodiment depicted in FIG. 1 and as depicted in FIG. 5, the drill rods (24) are arranged in a nesting pattern or as a "special array" in the single storage row (144) or storage section which is provided for the drill rods (24) in each of the storage areas (140,142).

The plurality of storage rows (144) which are provided for the inner core barrels (32) in each of the storage areas (140, 142) are sufficiently narrow so that the inner core barrels (32) are aligned in single file in the storage rows (144). A sufficient number of storage rows (144) is provided for the inner core barrels (32) in each of the storage areas (140,142) to accommodate one half of the inner core barrels (32) which are expected to be used during drilling.

An extra storage row (144) for the inner core barrels (32) is also provided in each of the storage areas (140,142) so that the inner core barrels (32) may be returned to different storage rows (144) after use than the storage rows (144) in which the inner core barrels (32) were stored before use, in order to facilitate arranging the inner core barrels (32) so that the order in which the inner core barrels (32) is used can be determined from the positions of the inner core barrels (32) in the storage areas (140,142).

In the exemplary embodiment depicted in FIG. 1 and as depicted in FIG. 5, the storage areas (140,142) do not move relative to the frame (50). As a result, moving the drill rods (24) and the inner core barrels (32) between the storage area (130) and the drilling axis (72) is performed entirely by movement of the handling device (132). As a result, the storage area (130) may be described as a non-rotating storage carousel comprising radial storage rows.

In the exemplary embodiment depicted in FIG. 1 and as depicted in FIG. 5, the storage area (130) may optionally include a storage row (144) or a storage section (not shown) to accommodate a casing which may be used to line the upper portion of the borehole during drilling, and the handling device (132) may be used to move the casing between the storage area (130) and the drilling axis (72) in a similar manner as the handling device (132) is used to move the drill rods (24) and the inner core barrels (32).

Referring to FIG. 1, in the exemplary embodiment, each of the first storage area (140) and the second storage area (142) is further comprised of a plate (148) which is oriented substantially horizontally adjacent to a lower end of the storage areas (140,142). The plate (148) defines holes which provide individual storage positions (150) for the drill rods (24) and the inner core barrels (32) within the storage rows (144). These individual storage positions assist in storing the drill rods (24) and the inner core barrels (32) more securely in the storage area (130) and also assist in arranging the drill rods (24) and the inner core barrels (32) in the storage area (130).

Referring to FIG. 5, in the exemplary embodiment depicted in FIG. 1, the drilling system (20) is further comprised of an intermediate storage area (152) which is located between the drilling axis (72) and the storage area (130). The purpose of the intermediate storage area (152) is to provide a location for the inner core barrels (32) to be placed by the wireline assembly (120) after they have been removed from the interior (26) of the drill string (22) with the inner core barrel retrieval device (40). After an inner core barrel (32) has been placed in the intermediate storage area (152), it may be moved with the handling device (132) between the intermediate storage area (152) and the storage area (130).

Referring to FIG. 4 and FIG. 7, in the exemplary embodiment depicted in FIG. 1, the drill head (80) is comprised of a modified Fraste R07D100 Rotary Head manufactured by Fraste S.p.a. of Nogara, Italy.

The drill head (80) is capable of longitudinal movement relative to the mast structure (70) along the drilling axis (72). In the exemplary embodiment depicted in FIG. 1, the drill head (80) is actuated hydraulically and remotely in order to move longitudinally along the drilling axis (72).

Some components of the drill head (80) are also capable of rotary movement relative to the drilling axis (72) in order to facilitate drilling and ancillary operations such as assembling and disassembling the drill string (22). More particularly, as depicted in FIG. 4 and FIG. 7, the drill head (80) is further comprised of a drill head swivel (160), a drill head drive section (162), and a drill head driven section (164).

The drill head drive section (162) is comprised of a hydraulic motor (166). In the exemplary embodiment, the hydraulic motor (166) is actuated remotely.

The drill head driven section (164) is rotated by the drill head drive section (162). A drill head drive linkage (168) comprising gears and bearings operably connects the drill head drive section (162) with the drill head driven section (164).

The drill head swivel (160) provides a rotatable connection between the drill head driven section (164) and the components of the drill head (80) which are located above the drill head swivel (160) so that the drill head driven section (164) can rotate relative to the components of the drill head (80) which are located above the drill head swivel (160).

The drill head driven section (164) is comprised of the drill head connector (88), which is used to connect the drill head (80) with a drill rod (24) and a drill string (22) in order to facilitate drilling.

The drill head driven section (164) is further comprised of a drill head chuck (170). The drill head chuck (170) provides a friction connection between the drill head (80) and a drill rod (24) and is used to connect the drill head (80) with the drill rod (24) and the drill string (22) temporarily in order to facilitate the assembly and/or disassembly of the drill string (22).

In the exemplary embodiment depicted in FIG. 1 and as depicted in FIG. 4 and FIG. 7, the drill head bore closure device (90), comprising the ball valve assembly, is mounted on the drill head (80) above the drill head swivel (160). The drill head bore closure device (90) represents a modification to the Fraste R07D100 Rotary Head.

In the exemplary embodiment depicted in FIG. 1 and as depicted in FIG. 4 and FIG. 7, the guiding collar (94) is mounted on the drill head (80) above the drill head bore closure device (90). The guiding collar (94) represents a modification to the Fraste R07D100 Rotary Head.

In the exemplary embodiment as depicted in FIG. 1 and as depicted in FIG. 4 and FIG. 7, a water inlet collar (172) is interposed between the drill head swivel (160) and the drill head bore closure device (90). The water inlet collar (172) is comprised of a water inlet port (174) for introducing water into the drill head bore (86) and the interior (26) of the drill string (22) as a lubricating and flushing fluid during drilling. The water inlet collar (172) represents a modification to the Fraste R07D100 Rotary Head.

During drilling, the drill head bore closure device (90) is actuated to the closed position so that the water which is introduced into the drill head bore (86) via the water inlet port (174) will pass through the interior (26) of the drill string (22) and not exit the drill head (80) through the drill head bore closure device (90). During insertion of an inner core barrel (32) and/or the inner core barrel retrieval device (40) into the interior (26) of the drill string (22) through the drill head bore (86) and/or removal of an inner core barrel (32) and/or the inner core barrel retrieval device (40) from the interior (26) of the drill string (22) through the drill head bore (86), the drill head bore closure device (90) is actuated to the open position so that the inner core barrel (32) and/or the inner core barrel retrieval device (40) may pass through the drill head bore (86).

Figure 8:
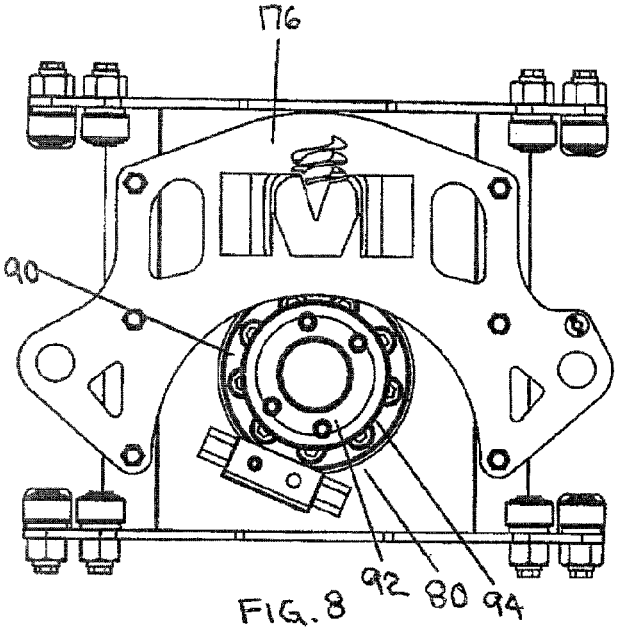
FIG. 8 is a plan view of the drill head depicted in FIG. 7.

Referring to FIG. 4 and FIG. 8, in the exemplary embodiment depicted in FIG. 1, the drill head (80) is mounted on the mast structure with a drill head frame (176). The drill head frame (176) is configured so that it will not interfere with the wireline assembly (120) and/or with the passage of the inner core barrel (32) and/or the inner core barrel retrieval device (40) through the drill head bore (86).

The exemplary embodiment of the drilling system (20) depicted in FIG. 1 is configured as a remotely operable drilling system for underwater wireline core drilling. In the exemplary embodiment depicted in FIG. 1, the drilling system (20) is configured to be essentially self-contained once deployed and to be generally capable of being operated without physical interaction. Furthermore, in the exemplary embodiment depicted in FIG. 1, the drilling system (20) is configured to be generally capable of operating remotely without manual adjustment or repair once deployed. Finally, in the exemplary embodiment depicted in FIG. 1, the drilling system (20) is configured to be relatively simple and robust so that it may operate relatively remotely and reliably in an underwater environment.

As one example, in the exemplary embodiment depicted in FIG. 1, the drill head (80) is always aligned with the drilling axis (72) and is thus always "on hole", with the result that the required movements of the drill head (80) and possible misalignments of the drill head (80) can be minimized.

As a second example, in the exemplary embodiment depicted in FIG. 1, essentially all movement which is required in order to move the drill rods (24) and the inner core barrels (32) between the storage area (130) and the drilling axis (72) is performed by moving the handling device (132), and not by moving the storage area (130), with the result that problems associated with movement or indexing of the storage area (130) can be avoided.

As a third example, in the exemplary embodiment depicted in FIG. 1, the movements which are required of the handling device (132) in order to move the drill rods (24) and the inner core barrels (32) between the storage area (130) and the drilling axis (72) are relatively simplified, with the result that actuation and control of the handling device (132) can be simplified.

The drilling system (20) may be used to perform a drilling method. The exemplary embodiment of the drilling system (20) depicted in FIG. 1 may be used to perform a wireline core drilling method. The method of the invention may be performed as a remotely operable method or as a non-remotely operable method. The method of the invention may also be performed as a land based method or as an underwater method.

In an exemplary embodiment of the method of the invention, the method may be performed as a remotely operable underwater wireline core drilling method. In the exemplary embodiment of the method described below, the method is performed using the exemplary embodiment of the drilling system (20) as depicted in FIG. 1 and described above.

In the exemplary embodiment of the method, the drilling system (20) is connected with a barge, ship or platform with the deployment cable (54) and the control cable (56). The deployment cable (54) is a structural cable which enables the drilling system (20) to be suspended from the barge, ship or platform. The control cable (56) may provide power to the drilling system, and also enables communication between the drilling system (20) and a control location. The control location may be the barge, ship or platform, or the control location may be a location which is capable of communicating with the barge, ship or platform.

Prior to deployment, the drilling system (20) is equipped with a sufficient number of drill rods (24) and inner core barrels (32) to facilitate the amount of drilling which is to occur while the drilling system (20) is deployed. The number of drill rods (24) which is required is dependent upon the maximum drilling depth which is anticipated for any one borehole, since the drill rods (24) may be reused in order to drill different boreholes. The number of inner core barrels (32) which is required is dependent upon the total drilling depth which is anticipated for all of the boreholes to be drilled and upon the number of core samples which are to be collected, since the inner core barrels (32) can be used only once during a single deployment of the drilling system (20).

The drill rods (24) are stored in the storage row (144) in each of the first storage area (140) and the second storage area (142) which is designated for the drill rods (24). The drill rods (24) will typically be interchangeable, so that there is typically no need to keep track of where and when a particular drill rod (24) is used.

The inner core barrels (32) are stored in the plurality of storage rows (144) in each of the first storage area (140) and the second storage area (142) which are designated for the inner core barrels (32). A storage row (144) in each of the first storage area (140) and the second storage area (142) is left empty to provide an extra storage row (144) for inner core barrels (32), thereby facilitating keeping track of where and when a particular inner core barrel (32) is used.

The drilling system (20) is lowered from the barge, ship or platform using the deployment cable (54) until the support legs (62) on the drilling system (20) engage an underwater ground surface (not shown). The support legs (62) are adjusted remotely so that the drilling system (20) is substantially level on the underwater ground surface.

Drilling is commenced with the drill head (80) connected with a drill string (22) comprising an outer core barrel (30) as an initial drill rod (24). A first inner core barrel (32) is releasably secured at the drilling position within the outer core barrel (30).

In order to connect the drill head (80) with the outer core barrel (30) as the drill string (22), the handling device (132) is actuated remotely to move the outer core barrel (30) from the storage area (130) to the drilling axis (72) and presents the outer core barrel (30) to the clamping mechanism (100).

The clamping mechanism (100), preferably the lower clamp (104), is actuated remotely in order to clamp the outer core barrel (30). The drill head (80) is actuated remotely to move longitudinally downward along the drilling axis (72) until the drill head connector (88) engages with the threaded connector at the upper end of the outer core barrel (30). The drill head (80) is then actuated remotely in order to rotate the drill head connector (88) and make up the threaded connection between the drill head connector (88) and the outer core barrel (30) and thereby connect the drill head (80) with the drill string (22). The clamping mechanism (100) is actuated remotely to release the drill string (22) which is now connected with the drill head (80).

Drilling is performed by actuating the drill head (80) remotely to rotate the drill string (22) and advance the drill string (22) longitudinally. During drilling, the drill head bore closure device (90) is actuated to the closed position and water is passed through the water inlet port (174) and through the drill head bore (86) to the interior (26) of the drill string (22). Drilling results in the collection of a core sample inside the first inner core barrel (32).

Once drilling has progressed for the full depth permitted by the length of the drill string (22), the drill head (80) is actuated remotely to stop drilling. The drill head (80) remains connected with the drill string (22).

The drill head bore closure device (90) is actuated remotely to the open position, and the wireline assembly (120) is actuated remotely to pass the inner core barrel retrieval device (40) through the drill head bore (86) into the interior (26) of the drill string (22) on the end of the winch cable (124) in order to retrieve the first inner core barrel (32).

The latching device (42) on the inner core barrel retrieval device (40) attaches with the fishing neck (34) on the first inner core barrel (32). Actuating the inner core barrel retrieval device (40) remotely to raise the inner core barrel retrieval device (40) slightly releases the first inner core barrel (32) from the drilling position within the outer core barrel (30). The first inner core barrel (32) and the inner core barrel retrieval device (40) are then removed from the interior (26) of the drill string (22) through the drill head bore (86) by actuating the wireline assembly (120) remotely to retract the winch cable (124) with the winch (122).

Once the first inner core barrel (32) has been retrieved from the interior (26) of the drill string (22), it is placed in the intermediate storage area (152) by the wireline assembly (120).

The handling device (132) is actuated remotely to move the first inner core barrel (32) from the intermediate storage area (152) to the storage area (130), where the first inner core barrel (32) is placed in the empty storage row (144). The handling device (132) is also actuated remotely to move a second inner core barrel (32) from the storage area (130) to the drilling axis (72). The second inner core barrel (32) may be moved from the storage area (130) to the drilling axis (72) either before or after the first inner core barrel (32) is moved from the intermediate storage area (152) to the storage area (130).

In the exemplary embodiment of the method, moving the second inner core barrel (32) from the storage area (130) to the drilling axis (72) includes selecting the second inner core barrel (32) from one of the storage rows (144) by extending the handling arm (134) toward the storage row (144), gripping the second inner core barrel (32) with the gripping device (136), retracting the handling arm (134), rotating the handling arm (134) about the vertical handling arm axis (138) in order to move the second inner core barrel (32) to the drilling axis (72), extending the handling arm (134) toward the drilling axis (72) in order to present the second inner core barrel (32) to the drilling axis (72), and vertically moving the gripping device (136) in order to present the lower end of the second inner core barrel (32) above the drill head (80).

The handling device (132) is then actuated remotely to release the second inner core barrel (32) from the gripping device (136) in order to drop the second inner core barrel (32) into the drill head bore closure device (90), guided by the guiding surface (92), and the second inner core barrel (32) passes through the drill head bore (86) and into the interior (26) of the drill string (22).

The second inner core barrel (32) is secured at the drilling position within the outer core barrel (30) by remotely actuating the drill head bore closure device (90) to the closed position and passing a fluid such as water through the water inlet port (174) in order to move the second inner core barrel (32) through the interior of the drill string (22) and in order to secure the second inner core barrel (32) at the drilling position.

The clamping mechanism (100), preferably the lower clamp (104), is actuated remotely in order to clamp the drill string (22) so that the drill string (22) is supported by the clamping mechanism (100). The clamping mechanism (100) may be actuated either before or after the second inner core barrel (32) is inserted into the interior (26) of the drill string (22).

Once the clamping mechanism (100) has been actuated to clamp the drill string (22), the drill head (80) may be remotely actuated to disconnect the drill head (80) from the drill string (22) by rotating the drill head connector (88).

The drill head (80) is remotely actuated to move longitudinally upward to provide a sufficient distance between the upper end of the drill string (22) and the lower drill head end (84) to enable a drill rod (24) to be interconnected between the drill head (80) and the upper end of the drill string (22) in order to lengthen the drill string (22).

The handling device (132) is then actuated remotely to move a drill rod (24) from the storage area (130) to the drilling axis (72).

In the exemplary embodiment of the method, moving the drill rod (24) from the storage area (130) to the drilling axis (72) includes selecting the drill rod (24) from one of the storage rows (144) by extending the handling arm (134) toward the storage row (144), gripping the drill rod (24) with the gripping device (136), retracting the handling arm (134), rotating the handling arm (134) about the vertical handling arm axis (138) in order to move the drill rod (24) to the drilling axis (72), extending the handling arm (134) toward the drilling axis (72) to present the drill rod (24) to the drilling axis (72), and vertically moving the gripping device (136) in order to present the drill rod (24) to the drilling axis (72) so that the upper end of the drill rod (24) is below the lower drill head end (84) and so that the lower end of the drill rod (24) is above the upper end of the drill string (22).

The centralizer (114) may optionally be remotely actuated in order to assist in aligning the drill rod (24) with the drilling axis (72). The handling device (132) presents the drill rod (24) to the drilling axis (72) so that the threaded connector at the lower end of the drill rod (24) is engaged with the threaded connector at the upper end of the drill string (22).

The drill head (80) is remotely actuated to move longitudinally downward to engage the upper end of the drill rod (24) with the drill head chuck (170). The drill head (80) is then remotely actuated first to clamp the drill rod (24) with the drill head chuck (170) and then to rotate the drill head chuck (170)

in order to make up the threaded connection between the lower end of the drill rod (24) and the upper end of the drill string (22).

The drill head (80) is actuated remotely to release the drill head chuck (170) and unclamp the drill rod (24). The drill head (80) is then actuated remotely to move longitudinally downward in order to engage the drill head connector (88) with the upper end of the drill rod (24). The drill head (80) is then actuated remotely to rotate the drill head connector (88) in order to make up the threaded connection between the drill head connector (88) and the upper end of the drill rod (24) and in order to tighten the threaded connection between the lower end of the drill rod (24) and the upper end of the drill string (22).

The clamping mechanism (100) is then actuated remotely to release the drill string (22) so that drilling can continue with the lengthened drill string (22).

The procedure set out above may be repeated as many times as necessary in order to drill the borehole to a desired depth and in order to collect a desired number of core samples.

Once drilling of the borehole has been completed to the desired depth and the desired number of core samples has been collected, the drill string (22) is retrieved from the borehole in a sequence which is similar but opposite to the sequence for drilling the borehole.

In order to retrieve the drill string (22) from the borehole, the drill head (80) is actuated remotely to lift the drill string (22) a short distance (approximately 30 centimeters) above the bottom of the borehole.

The drill head bore closure device (90) is actuated remotely to the open position, and the wireline assembly (120) is actuated remotely to pass the inner core barrel retrieval device (40) through the drill head bore (86) into the interior (26) of the drill string (22) on the end of the winch cable (124) in order to retrieve the final inner core barrel (32).

The latching device (42) on the inner core barrel retrieval device (40) attaches with the fishing neck (34) on the final inner core barrel (32). Actuating the inner core barrel retrieval device (40) remotely to raise the inner core barrel retrieval device (40) slightly releases the final inner core barrel (32) from the drilling position within the outer core barrel (30). The final inner core barrel (32) and the inner core barrel retrieval device (40) are then removed from the interior (26) of the drill string (22) through the drill head bore (86) by actuating the wireline assembly (120) remotely to retract the winch cable (124) with the winch (122).

Once the final inner core barrel (32) has been retrieved from the interior (26) of the drill string (22), it is placed in the intermediate storage area (152) by the wireline assembly (120).

The handling device (132) is actuated remotely to move the final inner core barrel (32) from the intermediate storage area (152) to the storage area (130), where the final inner core barrel (32) is placed in the appropriate storage row (144) so that the order of the inner core barrels (32) in the storage rows is maintained.

The clamping mechanism (100) is actuated remotely in order to clamp the drill string (22) with either the upper clamp (102) or the lower clamp (104). If the upper clamp (102) is clamping the drill string (22), the threaded connection between the drill head connector (88) and the upper end of the drill string (22) may be broken either by actuating the drill head (80) remotely to rotate the drill head connector (88) or by actuating the clamping mechanism (100) remotely to rotate the upper clamp (102). If the lower clamp (104) is clamping the drill string (22), the threaded connection between the drill head connector (88) and the upper end of the drill string (22) is broken by actuating the drill head (80) remotely to rotate the drill head connector (88).

After the drill head (80) is disconnected from drill string (22), the drill head (80) is actuated remotely to move the drill head (80) longitudinally upward to engage the upper end of the drill string (22) with the drill head chuck (170), and the drill head (80) is then actuated remotely to clamp the drill string (22) with the drill head chuck (170).

The drill head (80) is actuated remotely in order to lift the drill string (22) so that the lower end of the drill rod (24) which is clamped by the drill head chuck (170) is positioned in the longitudinal clamp gap (106) between the upper clamp (102) and the lower clamp (104).

The clamping mechanism (100) is actuated remotely so that the drill string (22) is clamped by both the upper clamp (102) and the lower clamp (104). The drill head (80) may be actuated remotely to release the drill string (22) from the drill head chuck (170).

The clamping mechanism (100) is then actuated remotely to rotate the upper clamp (102) in order to loosen the threaded connection between the drill rod (24) which is clamped by the upper clamp (102) and the drill rod (24) which is clamped by the lower clamp (104).

If the drill head (80) is not clamped by the drill head chuck (170), the drill head (80) is actuated remotely in order to clamp the drill string (22) with the drill head chuck (170) and the clamping mechanism (100) is actuated remotely in order to release the drill string (22).

The drill head is actuated remotely in order to lift the drill string (22) so that the lower end of the drill rod (24) which is clamped by the drill head chuck (170) is positioned above the upper clamp (102).

The clamping mechanism (100), preferably the lower clamp (104), is actuated remotely to clamp the drill string (22). The drill head (80) is then actuated remotely to rotate the drill head chuck (170) in order to break the threaded connection between the lower end of the drill rod (24) which is clamped by the drill head chuck (170) and the upper end of the adjacent drill rod (24).

The handling device (132) is actuated remotely to move to the drilling axis (72), extend the handling arm (134) toward the drilling axis (72), and grip with the gripping device (136) the drill rod (24) which is clamped by the drill head chuck (170).

The drill head (80) is actuated remotely to release the drill rod (24) from the drill head chuck (170) and the handling device (132) is actuated remotely in order to move the drill rod (24) from the drilling axis (72) to the storage row (144) in one of the first storage area (140) or the second storage area (142) which is designated for drill rods (24).

In the exemplary embodiment of the method, moving the drill rod (24) from the drilling axis (72) to the storage row (144) includes retracting the handling arm (134) from the drilling axis (72), rotating the handling arm (134) about the vertical handling arm axis (138) in order to move the drill rod (24) to the storage row (144), extending the handling arm (134) toward the storage row (144) to present the drill rod (24) to the storage row (144), and vertically moving the gripping device (136) as may be necessary in order to present the drill rod (24) to the storage row (144) so that the drill rod (24) can be placed in the storage row (144).

The drill head (80) is then actuated remotely to move longitudinally downward so that the drill head chuck (170) engages the upper end of the drill rod (24) which is clamped by the clamping mechanism (100), the drill head (80) is actuated remotely to clamp the drill rod (24) with the drill head chuck (170), the clamping mechanism (100) is actuated remotely to release the drill string (22), and the drill head (80) is actuated remotely in order to lift the drill string (22) so that the lower end of the drill rod (24) which is clamped by the drill head chuck (170) is positioned in the longitudinal clamp gap (106) between the upper clamp (102) and the lower clamp (104).

The procedure set out above is repeated until the entire drill string (22) has been retrieved from the borehole and the drill rods (24) comprising the drill string (22) are returned to the storage area (130).

The drilling system (20) may then be raised using the deployment cable (54) in order to move the drilling system (20) to a new drilling location or to return the drilling system (20) to the barge, ship or platform from which it was deployed.

The exemplary embodiment of the drilling method may optionally include the installation of a casing in the borehole, the use of the casing clamp (110) to support the casing in the borehole, and the removal of the casing from the borehole following the drilling of the borehole. In the exemplary embodiment, the casing clamp (110) is actuated remotely to selectively clamp and release the casing.

Where applicable in the exemplary embodiment of the method, the use of casing and the casing clamp (110) includes interaction between the handling device (132) and the casing clamp (110), and coordination with the drill head (80) so that the drill head (80) does not obstruct the installation and/or removal of the casing.

In the exemplary embodiment of the method, the drill head (80) is disconnected from the drill string (22), the drill string (22) is supported by the clamping mechanism (100), and the drill head (80) is moved longitudinally upward in order to facilitate inserting the casing into the borehole, so that the handling device (132) may present the casing to the drilling axis (72) and to the casing clamp (110) without obstruction from the drilling head (80).

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A remotely operable underwater drilling system for use with a drill string comprising at least one drill rod and for use with an inner core barrel which is adapted to be contained within an interior of the drill string, the drilling system comprising:

(a) a frame;

(b) a deployment connector attached to the frame, for connecting the drilling system with a deployment cable so that the drilling system may be suspended from the deployment cable in a body of water;

(c) an adjustable support mechanism attached to the frame, for enabling the drilling system to be supported on an underwater ground surface at a substantially level orientation;

(d) a mast structure mounted on the frame, wherein the mast structure defines a drilling axis for the drill string;

(e) a drill head mounted on the mast structure such that the drill head is aligned with the drilling axis and longitudinally reciprocable along the drilling axis, wherein the drill head has an upper drill head end and a lower drill head end, wherein the drill head defines a drill head bore extending fully through the drill head from the upper drill head end to the lower drill head end, wherein the drill head bore is substantially coaxial with the drilling axis, and wherein the drill head is comprised of:

i) a drill head connector for connecting the drill head with the drill string along the drilling axis; and (ii) a drill head bore closure device adjacent to the upper drill head end, wherein the drill head bore closure device is actuatable between a closed position in which the drill head bore is closed and an open position in which the drill head bore is open, wherein the inner core barrel may be inserted into and removed from the interior of the drill string through the drill head bore when the drill head is connected with the drill string and the drill head bore closure device is actuated to the open position, and wherein an inner core barrel retrieval device may be inserted into and removed from the interior of the drill string through the drill head bore when the drill head is connected with the drill string and the drill head bore closure device is actuated to the open position;

(f) a clamping mechanism mounted on the mast structure, for supporting the drill string along the drilling axis when the drill head is not connected with the drill string; and (g) a guiding surface located at the upper drill head end, for guiding the inner core barrel and the inner core barrel retrieval device into the drill head bore.

2. The drilling system as claimed in claim 1 wherein the drill head bore closure device is comprised of a valve.

3. The drilling system as claimed in claim 1 wherein the inner core barrel retrieval device is comprised of a latching device for latching onto the inner core barrel.

4. The drilling system as claimed in claim 3, further comprising a wireline assembly attached to the frame, wherein the wireline assembly is comprised of a winch, a winch cable, and the inner core barrel retrieval device.

5. The drilling system as claimed in claim 1 wherein the guiding surface is comprised of a cone-shaped surface which surrounds the drill head bore at the upper drill head end.

6. The drilling system as claimed in claim 1, further comprising a storage area for storing a plurality of the drill rods and a plurality of the inner core barrels.

7. The drilling system as claimed in claim 6, further comprising a handling device for moving the drill rods and the inner core barrels between the storage area and the drilling axis.

8. The drilling system as claimed in claim 7 wherein the handling device is comprised of a handling arm.

9. The drilling system as claimed in claim 8 wherein the handling device has a vertical handling device axis, wherein the handling arm is rotatable in a horizontal plane about the vertical handling device axis, wherein the storage area is comprised of a plurality of storage rows for drill rods and inner core barrels, and wherein the plurality of storage rows are arranged as spokes extending radially along storage row lines which substantially intersect with the vertical handling device axis.

10. The drilling system as claimed in claim 9 wherein the handling arm is extendible and retractable radially relative to the vertical handling device axis.

11. The drilling system as claimed in claim 10 wherein the handling arm is comprised of a gripping device for gripping drill rods and inner core barrels and wherein the gripping device is vertically movable in order to raise and lower the gripping device.

12. The drilling system as claimed in claim 11 wherein the storage area is comprised of a first storage area and a second storage area and wherein the first storage area and the second storage area are arranged so that the drilling system is substantially balanced when the first storage area and the second storage area are filled with drill rods and inner core barrels.

13. The drilling system as claimed in claim 1 wherein the drilling system is remotely operable from a control location, further comprising a control cable for operably connecting the drilling system with the control location.

14. The drilling system as claimed in claim 1 wherein the adjustable support mechanism is comprised of a plurality of support legs and wherein at least one of the support legs is adjustable in order to level the drilling system.

15. The drilling system as claimed in claim 1 wherein the drill head is mounted on the mast structure so that the drill head is fixedly aligned with the drilling axis.

16. A method of drilling, the method comprising:

(a) providing a drilling system, wherein the drilling system is comprised of a drill head, wherein the drill head has an upper drill head end and a lower drill head end, wherein the drill head defines a drill head bore extending fully through the drill head from the upper drill head end to the lower drill head end and wherein the drill head is comprised of a drill head bore closure device adjacent to the upper drill head end, wherein the drill head bore closure device is actuatable between a closed position in which the drill head bore is closed and an open position in which the drill head bore is open, and wherein the drilling SYS tem further comprises a guiding surface located at the upper drill head end, for guiding an inner core barrel and an inner core barrel retrieval device into the drill head bore;

(b) positioning the drill head so that the drill head is aligned with a drilling axis defined by the drilling system;

(c) connecting the drill head with a drill string, wherein the drill string is comprised of a first inner core barrel secured at a drilling position within an interior of the drill string;

(d) drilling by actuating the drill head and longitudinally advancing the drill head along the drilling axis;

(e) guiding the inner core barrel retrieval device into the drill head bore with the guiding surface and passing the inner core barrel retrieval device through the drill head bore and into the interior of the drill string while the drill head is connected with the drill string;

(f) attaching the first inner core barrel with the inner core barrel retrieval device in the interior of the drill string;

(g) removing the first inner core barrel and the inner core barrel retrieval device from the interior of the drill string through the drill head bore while the drill head is connected with the drill string;

(h) guiding a second inner core barrel into the drill head bore with the guiding surface and passing the second inner core barrel through the drill head bore and into the interior of the drill string while the drill head is connected with the drill string;

(i) closing the drill head bore by actuating the drill head bore closure device to the closed position after passing the second inner core barrel through the drill head bore and into the interior of the drill string.

17. The method as claimed in claim 16, further comprising pumping a fluid through the drill string in order to move the second inner core barrel through the interior of the drill string and in order to secure the second inner core barrel at the drilling position.

18. The method as claimed in claim 17, further comprising disconnecting the drill head from the drill string while supporting the drill string with a clamping mechanism associated with the drilling system.

19. The method as claimed in claim 18, further comprising lengthening the drill string by interconnecting a drill rod between the drill head and an upper end of the drill string while the drill string is supported with the clamping mechanism.

20. The method as claimed in claim 19, further comprising drilling, after lengthening the drill string, by actuating the drill head and longitudinally advancing the drill head along the drilling axis.

21. The method as claimed in claim 19 wherein interconnecting the drill rod between the drill head and the upper end of the drill string is comprised of moving the drill rod from a storage area to the drilling axis with a handling device.

22. The method as claimed in claim 21 wherein the handling device is comprised of a handling arm, wherein the handling device has a vertical handling device axis, wherein the handling arm is rotatable in a horizontal plane about the vertical handling device axis, wherein the storage area is comprised of a plurality of storage rows, wherein the plurality of storage rows are arranged as spokes extending radially along storage row lines which substantially intersect with the vertical handling device axis, and wherein moving the drill rod from the storage area to the drilling axis with the handling device is comprised of selecting the drill rod from one of the storage rows and rotating the handling arm about the vertical handling device axis in order to move the drill rod to the drilling axis.

23. The method as claimed in claim 22 wherein the handling arm is extendible and retractable radially relative to the vertical handling deice axis, wherein selecting the drill rod from one of the storage rows is comprised of extending the handling arm toward the storage row, and wherein moving the drill rod to the drilling axis is further comprised of extending the handling arm toward the drilling axis.

24. The method as claimed in claim 23 wherein the handling arm is comprised of a gripping device and wherein moving the drill rod from the storage area to the drilling axis is further comprised of vertically moving the gripping device in order to present the drill rod between the drill head and the upper end of the drill string.

25. A remotely operable underwater drilling system for use with a drill string comprising at least one drill rod and for use with an inner core barrel which is adapted to be contained within an interior of the drill string, the drilling system comprising:

(a) a frame;

(b) a deployment connector attached to the frame, for connecting the drilling system with a deployment cable so that the drilling system may be suspended from the deployment cable in a body of water;

(c) an adjustable support mechanism attached to the frame, for enabling the drilling system to be supported on an underwater ground surface at a substantially level orientation;

(d) a mast structure mounted on the frame, wherein the mast structure defines a drilling axis for the drill string;

(e) a drill head mounted on the mast structure such that the drill head is aligned with the drilling axis and longitudinally reciprocable along the drilling axis, wherein the drill head has an upper drill head end and a lower drill head end, wherein the drill head defines a drill head bore extending fully through the drill head from the upper drill head end to the lower drill head end, wherein the drill head bore is substantially coaxial with the drilling axis, and wherein the drill head is comprised of:

(i) a drill head connector for connecting the drill head with the drill string along the drilling axis;

(ii) a drill head bore closure device adjacent to the upper drill head end, wherein the drill head bore closure device is actuatable between a closed position in which the drill head bore is closed and an open position in which the drill head bore is open, and wherein the inner core barrel may be inserted into and removed from the interior of the drill string through the drill head bore when the drill head is connected with the drill string and the drill head bore closure device is actuated to the open position; and (iii) a drill head swivel located between the drill head connector and the drill head bore closure device so that the drill head connector is rotatable relative to the drill head bore closure device; and (f) a clamping mechanism mounted on the mast structure, for supporting the drill string along the drilling axis when the drill head is not connected with the drill string.

26. The drilling system as claimed in claim 25 wherein an inner core barrel retrieval device may be inserted into and removed from the interior of the drill string through the drill head bore when the drill head is connected with the drill string and the drill head bore closure device is actuated to the open position.

27. The drilling system as claimed in claim 26, further comprising a guiding surface located at the upper drill head end, for guiding the inner core barrel and the inner core barrel retrieval device into the drill head bore.

28. A method of drilling, the method comprising:

(a) providing a drilling system, wherein the drilling system is comprised of a drill head, wherein the drill head has an upper drill head end and a lower drill head end, and wherein the drill head defines a drill head bore extending fully through the drill head from the upper drill head end to the lower drill head end, and wherein the drill head is comprised of:

(i) drill head connector for connecting the drill head with a drill string;

(ii) a drill head bore closure device adjacent to the upper drill head end, wherein the drill head bore closure device is actuatable between a closed position in which the drill head bore is closed and an open position in which the drill head bore is open; and (iii) a drill head swivel located between the drill head connector and the drill head bore closure device so that the drill head connector is rotatable relative to the drill head bore closure device;

(b) positioning the drill head so that the drill head is aligned with a drilling axis defined by the drilling system;

(c) connecting the drill head with the drill string with the drill head connector, wherein the drill string is comprised of a first inner core barrel secured at a drilling position within an interior of the drill string;

(d) drilling by actuating the drill head so that the drill head connector and the drill string rotate relative to the drill head bore closure device and longitudinally advancing the drill head along the drilling axis;

(e) passing an inner core barrel retrieval device through the drill head bore and into the interior of the drill string while the drill head is connected with the drill string;

(f) attaching the first inner core barrel with the inner core barrel retrieval device in the interior of the drill string; and (g) removing the first inner core barrel and the inner core barrel retrieval device from the interior of the drill string through the drill head bore while the drill head is connected with the drill string.

* * * * *